US007350357B2

(12) United States Patent
Chen et al.

(10) Patent No.: US 7,350,357 B2
(45) Date of Patent: Apr. 1, 2008

(54) NOZZLE

(75) Inventors: Alexander G. Chen, Ellington, CT (US); Catalin G. Fotache, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 681 days.

(21) Appl. No.: 10/843,812

(22) Filed: May 11, 2004

(65) Prior Publication Data

US 2005/0252217 A1 Nov. 17, 2005

(51) Int. Cl.
*F23R 3/30* (2006.01)

(52) U.S. Cl. ..... 60/737; 60/748

(58) Field of Classification Search ..... 60/737, 60/738, 747, 748, 776
See application file for complete search history.

(56) References Cited

U.S. PATENT DOCUMENTS

| | | | | |
|---|---|---|---|---|
| 3,938,326 | A | | 2/1976 | DeCorso et al. |
| 4,967,561 | A | | 11/1990 | Bruhwiler et al. |
| 5,289,685 | A | | 3/1994 | Hoffa |
| 5,323,614 | A | | 6/1994 | Tsukahara et al. |
| 5,339,635 | A | | 8/1994 | Iwai et al. |
| 5,359,847 | A | * | 11/1994 | Pillsbury et al. ..... 60/737 |
| 5,361,576 | A | | 11/1994 | Muller |
| 5,394,688 | A | | 3/1995 | Amos |
| 5,603,211 | A | * | 2/1997 | Graves ..... 60/776 |
| 5,713,206 | A | | 2/1998 | McWhirter et al. |
| 5,899,074 | A | | 5/1999 | Komatsu et al. |
| 5,983,642 | A | | 11/1999 | Parker et al. |
| 6,092,363 | A | | 7/2000 | Ryan |
| 6,598,383 | B1 | | 7/2003 | Vandervort et al. |
| 2004/0060301 | A1 | | 4/2004 | Chen et al. |

FOREIGN PATENT DOCUMENTS

| | | |
|---|---|---|
| RU | 2050511 C1 | 12/1995 |
| SU | 1688045 A2 | 10/1991 |

OTHER PUBLICATIONS

European Search Report for EP Application No. 05252832.0, dated Aug. 11, 2005.
Russian Office Action for Russian Patent Application No. 2005-113955.

* cited by examiner

*Primary Examiner*—L. J. Casaregola
(74) *Attorney, Agent, or Firm*—Bachman & LaPointe, P.C.

(57) ABSTRACT

The fuel injector has a first means defining a number of flowpaths each having an inlet for receiving air and an outlet for discharging a fuel/air mixture. One or more arrays of vanes are each positioned to impart swirl to an associated one or more of the flowpaths. Second means are provided for introducing the fuel to the air.

15 Claims, 2 Drawing Sheets

NOZZLE

U.S. GOVERNMENT RIGHTS

The invention was made with U.S. Government support under contract DEFC02-00CH11060 awarded by the U.S. Department of Energy. The U.S. Government has certain rights in the invention.

BACKGROUND OF THE INVENTION (1) Field of the Invention

The invention relates to fuel injectors. More particularly, the invention relates to multi-point fuel/air injectors for gas turbine engines.

(2) Description of the Related Art

A well-developed field exists in combustion technology for gas turbine engines. U.S. patent application Ser. No. 10/260,311 (the '311 application) filed Sep. 27, 2002 discloses structure and operational parameters of an exemplary multi-point fuel/air injector for a gas turbine engine. The exemplary injectors of the '311 application include groups of fuel/air nozzles for which the fuel/air ratio of each nozzle group may be separately controlled. Such control may be used to provide desired combustion parameters. The disclosure of the '311 application is incorporated by reference herein as if set forth at length.

Nevertheless, there remain opportunities for improvement in fuel injector construction.

SUMMARY OF THE INVENTION

Accordingly, one aspect of the invention involves a fuel injector having a number of generally annular passageways. The passageways are coaxial about an injector axis. Each passageway defines a gas flowpath having an inlet for receiving air and an outlet for discharging a fuel/air mixture. There are a number of arrays of vanes. Each array is positioned in an associated one of the passageways. A number of fuel flows introduce the fuel to the air.

In various implementations, the vanes in a first of the arrays may be oriented to provide a first circulation. The vanes in a second of the arrays, inboard of the first of the arrays, may be oriented to provide a second circulation of like sign to the first circulation. A third of the arrays may be between the first and second of the arrays. The apparatus may be operated to provide a first combustion zone, a second combustion zone inboard of the first combustion zone and leaner than the first combustion zone, and a third combustion zone inboard of the second combustion zone and richer than the second combustion zone. The first, second, and third combustion zones may be below stoichiometric. The apparatus may be used with a gas turbine engine combustor. There may be at least ten vanes in at least a first and second of the arrays.

Another aspect of the invention involves a method for engineering such an apparatus. Orientations of vanes in first and second arrays are selected so as to provide a target level of at least one of: emissions levels; and pressure fluctuation levels. In various implementations, the orientations of vanes in first and second of the arrays may be selected so as to provide a target level of both of: emissions levels; and pressure fluctuation levels. the selecting is performed in view of or in combination with fuel/air ratios of the one or more passageways at one or more operating conditions. The selecting may be performed so as to achieve a target stabilization of one or more cool zones by one or more hot zones. The emissions levels may include levels of UHC, CO, and NOX at one or more power levels.

Another aspect of the invention involves a fuel injector apparatus having first means defining a number of flowpaths. Each flowpath has an inlet for receiving air and an outlet for discharging a fuel/air mixture. One or more arrays of vanes are each positioned to impart swirl to an associated one or more of the flowpaths. Second means introduce the fuel to the air.

In various implementations, the vanes in a first of the arrays may be oriented to provide a first circulation. The vanes in a second of the arrays, inboard of the first may be oriented to provide a second circulation of like sign. The apparatus may operate to provide: a first combustion zone; a second combustion zone inboard of the first and cooler than the first; and a third combustion zone inboard of the second and hotter than the second. The first, second, and third combustion zones may be below stoichiometric.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
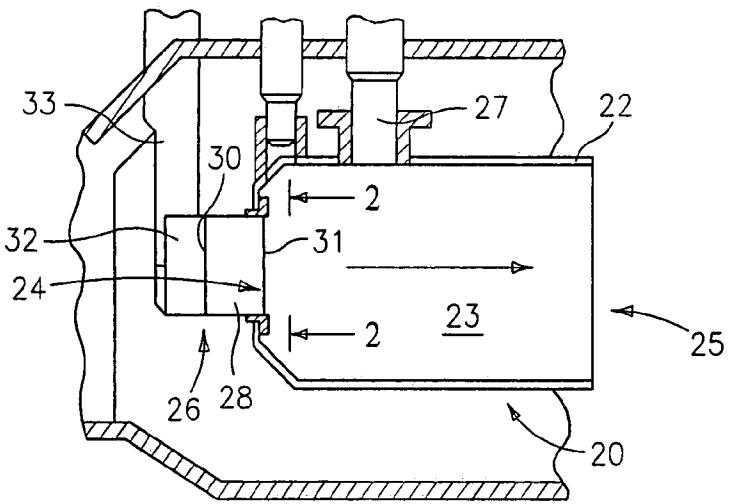
FIG. 1 is a partially schematic sectional view of a gas turbine engine combustor.

FIG. 1 shows a combustor 20 for a gas turbine engine (e.g., an industrial gas turbine engine used for electrical power generation). The combustor has a wall structure 22 surrounding an interior 23 extending from an upstream inlet 24 receiving air from a compressor section of the engine to a downstream outlet 25 discharging combustion gases to the turbine section. Near the inlet, the combustor includes an injector 26 for introducing fuel to the air received from the compressor to introduce a fuel/air mixture to the combustor interior. An ignitor 27 is positioned to ignite the fuel/air mixture.

The injector 26 includes a body 28 extending from an upstream end 30 to a downstream end 31 with a number of passageways therebetween forming associated fuel/air nozzles. Fuel may be delivered to the body 28 by a manifold 32 mounted to the body at the upstream end 30 and fed through one or more fuel lines in a leg 33 penetrating from outside the engine core flowpath. Air may pass through the manifold from upstream.

Figure 4:
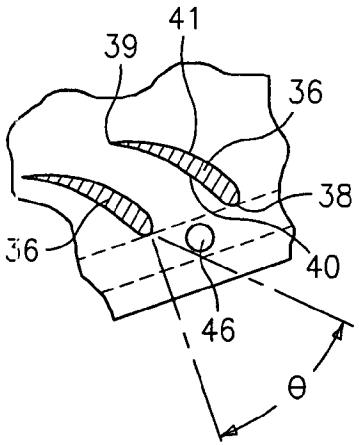
FIG. 4 is a partially schematic partial sectional view of the body of FIG. 2 taken along line 4-4.
Figure 2:
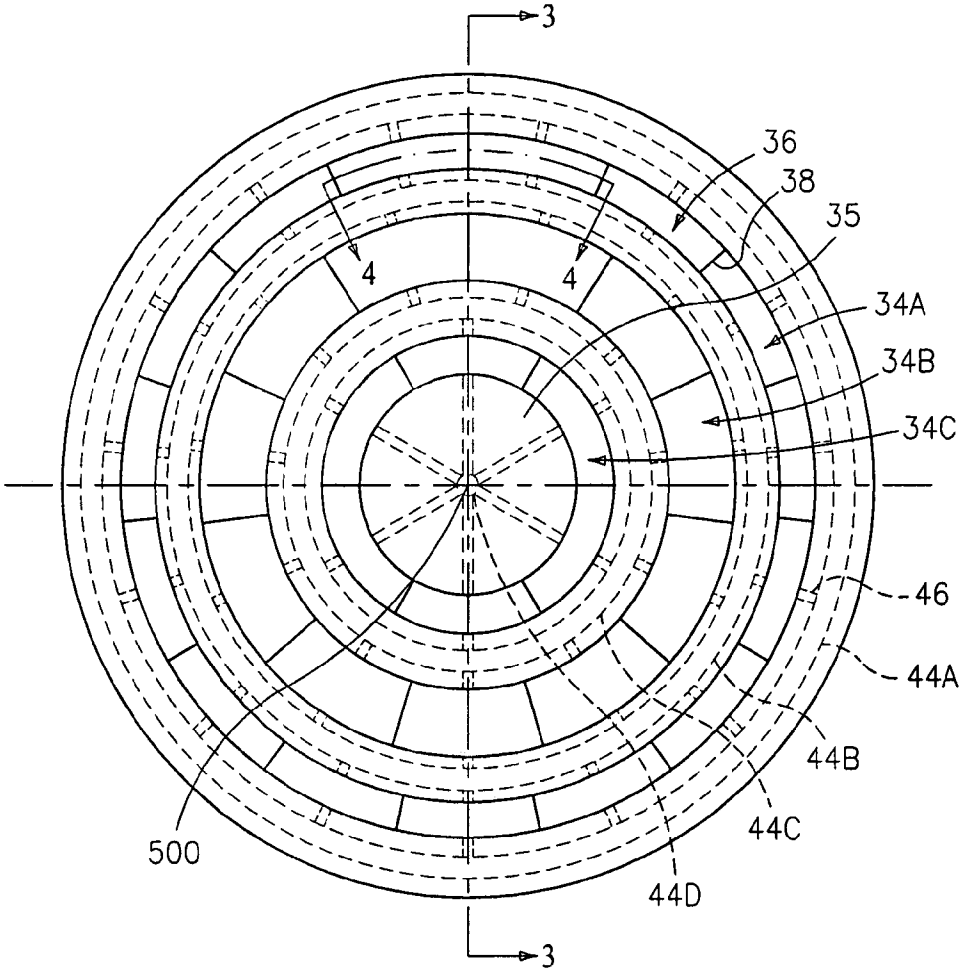
FIG. 2 is a partially schematic downstream end view of an injector of the combustor of FIG. 1.

FIG. 2 shows the body 28 having a central axis 500 and passageways 34A-34C formed as concentric circular rings about a single centerbody portion 35 and aligned with associated air passageways through the manifold. Alternatively, there may be a central passageway. Each passageway contains a circumferential array of vanes 36, each vane extending from a leading edge 38 to a trailing edge 39 (FIG. 4) and having pressure and suction sides 40 and 41 (FIG. 4). The exemplary vanes extend generally radially, with vane chords angled relative to the longitudinal direction by an angle θ. Other passageway and vane configurations are possible. The vanes of each passageway may well differ in span, chordlength, shape, angle, or the like amongst the passageways.

Figure 3:
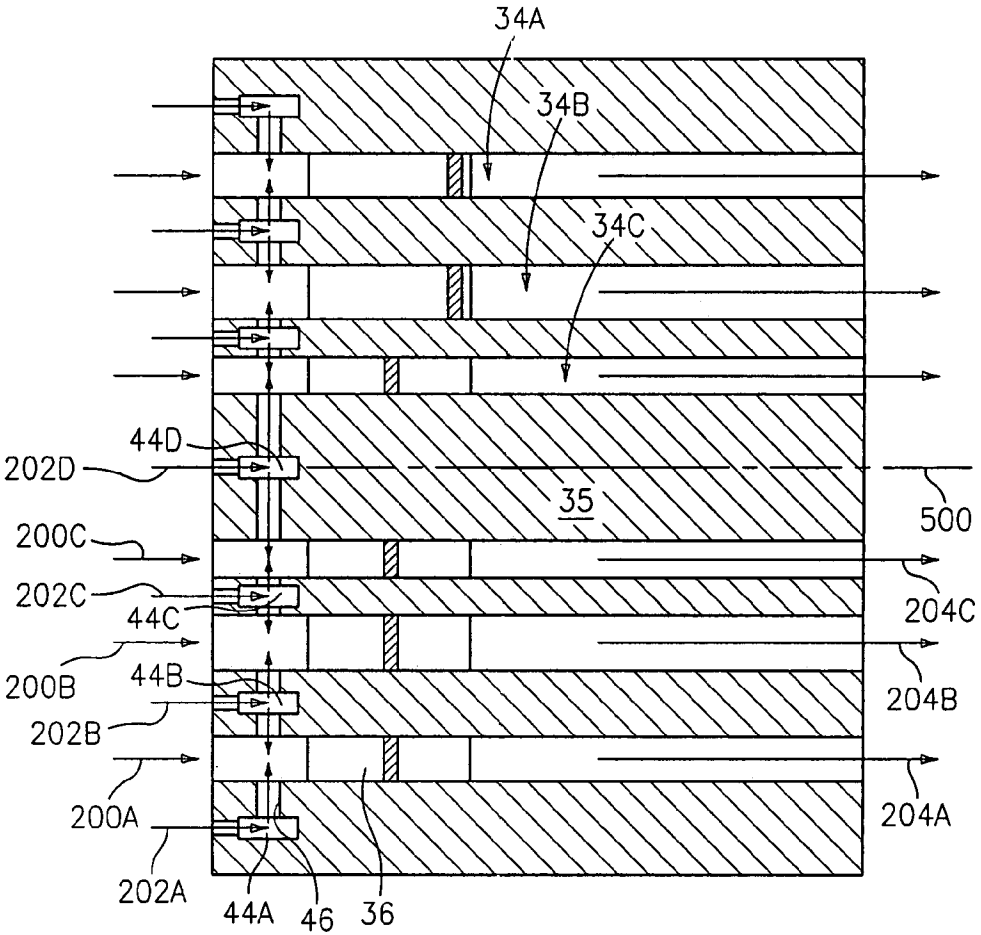
FIG. 3 is a partially schematic sectional view of a body of the injector of FIG. 2 taken along line 3-3.

FIG. 3 shows air and fuel flows 200A-C and 202A-D, respectively, entering the body 28 from the manifold 32 and/or upstream thereof. The air flows are generally annular, entering inlets to the associated passageways 34A-34C formed in the upstream face 30. The fuel flows may enter one or more plenums 44A-44D inboard and/or outboard of the passageways 34A-C. Fuel exits the adjacent plenums into the passageways through at least partially radial outlet passageways 46 forming fuel inlets to the passageways 34A-C. In the passageways, the fuel mixes with the air to be discharged as mixed fuel/air flows 204A-C. Other fueling configurations are possible.

The vanes function to impart swirl about the axis 500 to the annular fuel/air flows 204A-C. The vane configurations and angles θ may be chosen to achieve desired flow properties at one or more desired operating conditions. The angles may be of the same sign or of opposite sign (e.g., to create a counter-swirl effect). The angles may be of like magnitude or different magnitude. Exemplary angle magnitudes are ≦60°, more narrowly, 10°-50°, and, most particularly, 20°-45°. In addition to different swirl magnitudes, the passageways 34A-C may have different spans. Some may be replaced by other configurations (e.g., rings of drilled passages). In various operational stages, each passageway may be fueled differently (e.g., as shown in the '311 application). Factors such as the swirl magnitude, radial position, and span of the passageways may be optimized in view of available fuel/air ratios to provide advantageous performance at one or more operating conditions.

An exemplary iterative optimization process may be performed in a reengineering of an existing injector. The factors may be iteratively varied. For each iteration, the combination of fuel/air ratios may be varied to establish associated operating conditions. Performance parameters may be measured at those operating conditions (e.g., efficiency, emissions, and stability). The structure and operational parameters associated with desired performance may be noted, with the structure being selected as the reengineered injector configuration and the operational parameters potentially being utilized to configure a control system. Optimization may use a figure of merit that includes appropriately weighted emissions parameters (e.g., of $NO_X$, CO, and unburned hydrocarbons (UHC)) and other performance characteristics (e.g., pressure fluctuation levels), resulting in an optimized configuration that gives the best (or at least an acceptable) combined performance based on these metrics. The degrees of freedom can be restricted to the fuel staging scheme (i.e., how much fuel flows through each of the passageways given a fixed total fuel flow) or can be extended to include the swirl angles of each of the passageways or the relative air flow rates associated with each of the passageways, based on their relative flow capacities. The former is a technique that can be used after the injector is built and can be used to tune the combustor to its best operating point. The latter technique is appropriately used before the final device is built.

Fueling may be used to create zones of different temperature. Relatively cool zones (e.g., by flame temperature) are associated with off-stoichiometric fuel/air mixtures. Relatively hot zones will be closer to stoichiometric. Cooler zones tend to lack stability. Locating a hotter zone adjacent to a cooler zone may stabilize the cooler zone. In an exemplary operation, different fuel/air ratios for the different nozzle rings may create an exemplary three annular combustion zones downstream of the injector: lean, yet relatively hot, outboard and inboard zones; and a leaner and cooler intermediate zone. The outboard and inboard zones provide stability, while the intermediate zone reduces total fuel flow in a low power setting (or range). As $NO_X$ generation is associated with high temperature, the low temperatures of the intermediate zone will have relatively low $NO_X$. By having an overall lean chemistry and good stability, desired advantageously low levels of UHC and CO may be achieved. Increasing/decreasing the equivalence ratio of the intermediate zone may serve to increase/decrease engine power while maintaining desired stability and low emissions.

In an exemplary configuration, the vanes are configured to permit operation at a condition wherein the outboard and inboard passageways 34A and 34C are run lean (e.g., an equivalence ratio in the vicinity of 0.4-0.7) and the intermediate passageway 34B is run yet leaner and cooler. This may create an associated three annular combustion zones downstream of the injector: lean outboard and inboard zones; and a leaner intermediate zone. The outboard and inboard zones provide stability, while the intermediate zone reduces total fuel flow in a low power setting while still maintaining desired advantageously low levels of UHC and CO. For such an exemplary three-zone operation, there may be at least three passageways operated at different fuel/air ratios. With more than three independently-fueled passageways (counting a central nozzle, if any), different fuel/air mixtures may facilitate altering the spatial distribution of the three zones or may facilitate yet more complex distributions (e.g., a lean trough within an intermediate rich zone to create more of a five-zone system). Two-zone operation is also possible.

Whereas the foregoing example has an overall lean chemistry exiting the nozzle, other implementations may have overall rich chemistries. A so-called rich-quench-lean operation introduces additional air downstream to produce lean combustion. Such operation may have an intermediate zone exiting the nozzle that is well above stoichiometric and thus also cool. The inboard and outboard zones may be closer to stoichiometric (whether lean or rich) and thus hotter and more stable to stabilize the intermediate zone. As $NO_X$ generation is associated with high temperature, the low temperatures of the intermediate zone (through which the majority of fuel may flow) will have relatively low $NO_X$. The inboard, and outboard zones may represent a lesser portion of the total fuel (and/or air) flow and thus the increase (if any) of $NO_X$ (relative to a uniform distribution of the same total amounts of fuel and air) in these zones may be offset. Yet other combinations of hot and cold zones and their absolute and relative fuel/air ratios may be used at least transiently for different combustor configurations and operating conditions.

With an exemplary combustion of methane fuel in air at 1.0 atm pressure, the flame may otherwise become unstable at equivalence ratios of about equal to or greater than 1.6 for rich and about equal to or less than 0.5 for lean. The cooler zone(s) could be run in these ranges (e.g., more narrowly, 0.1-0.5 or 1.6-5.0). The hotter zone(s) could be run between ).5 and 1.6 (e.g., more narrowly 0.5-0.8 or 1.3-1.6, or, yet more narrowly, 0.5-0.6 or 1.5-1.6; staying away from stoichiometric to avoid high flame temperature and, therefore, reduce $NO_X$ formation). Other fuels and pressures could be associated with other ranges.

One or more embodiments of the present invention have been described. Nevertheless, it will be understood that various modifications may be made without departing from the spirit and scope of the invention. For example, when implemented as a redesign/reengineering of an existing injector, details of the existing injector or of the associated combustor may influence details of the particular implementation. More complex structure and additional elements may be provided. There may be multiple different vane configurations even within a given passageway. Non-circular concentric flowpaths and other flowpath configurations are possible. While illustrated with regard to a can-type combustor, other combustor configurations, including annular combustors, may also be possible. Accordingly, other embodiments are within the scope of the following claims.

What is claimed is:

1. A fuel injector apparatus comprising:

a plurality of generally annular passageways, the passageways being coaxial about an injector axis, each passageway defining a gas flowpath having an inlet for receiving air and an outlet for discharging a fuel/air mixture;

a plurality of arrays of vanes, each array in an associated one of the passageways; and a plurality of fuel flows introducing said fuel to said air, wherein:

each of the vanes in a first of the arrays is oriented at a first relative orientation to provide a first circulation; and each of the vanes in a second of the arrays, inboard of said first of said arrays, is oriented at a second relative orientation different from the first relative orientation, to provide a second circulation of like sign to the first circulation.

2. The apparatus of claim 1 further comprising:

a third of said arrays between the first and second of said arrays.

3. The apparatus of claim 1 operating to provide:

a first combustion zone;

a second combustion zone inboard of the first and leaner than the first; and a third combustion zone inboard of the second and richer than the second.

4. The apparatus of claim 3 wherein the first second, and third combustion zones are below stoichiometric.

5. The apparatus of claim 1 used with a gas turbine engine combustor.

6. The apparatus of claim 1 wherein there are at least ten vanes in each of at least the first and second of the arrays.

7. A fuel injector apparatus comprising:

first means defining a plurality of flowpaths having an inlet for receiving air and an outlet for discharging a fuel/air mixture;

one or more arrays of vanes, each such array in positioned to impart swirl to an associated one or more of the flowpaths; and second means for introducing said fuel to said air, wherein:

each of the vanes in a first of the arrays is oriented at a first relative orientation to provide a first circulation; and each of the vanes in a second of the arrays, inboard of said first of said arrays, is oriented at a second relative orientation different from the first relative orientation, to provide a second circulation of like sign to the first circulation.

8. The apparatus of claim 7 comprising a plurality of said arrays.

9. The apparatus of claim 7 wherein:

each of at least two of the flowpaths substantially circumscribe an axis of the apparatus.

10. The apparatus of claim 7 wherein:

each of at least two of the flowpaths is substantially annular.

11. The apparatus of claim 7 wherein:

each of at least two of the flowpaths is substantially concentric with each other.

12. The apparatus of claim 7 operating to provide:

a first combustion zone;

a second combustion zone inboard of the first and cooler than the first; and a third combustion zone inboard of the second and hotter than the second.

13. The apparatus of claim 12 wherein the first, second, and third combustion zones are below stoichiometric.

14. The apparatus of claim 7 wherein:

a chord angle of the vanes of the first of the arrays is of a different magnitude than a chord angle of the vanes of the second of the arrays.

15. A fuel injector apparatus comprising:

a plurality of generally annular passageways, the passageways being coaxial about an injector axis, each passageway defining a gas flowpath having an inlet for receiving air and an outlet for discharging a fuel/air mixture;

a plurality of arrays of vanes, each array in an associated one of die passageways; and a plurality of fuel flows introducing said fuel to said air, wherein:

each of the vanes in a first of the arrays is oriented at a first relative orientation;

each of the vanes in a second of the arrays is oriented at a second relative orientation different from the first relative orientation; and there are at least ten vanes in each of at least the first and second of the arrays.

* * * * *

UNITED STATES PATENT AND TRADEMARK OFFICE

CERTIFICATE OF CORRECTION

PATENT NO. : 7,350,357 B2
APPLICATION NO. : 10/843812
DATED : April 1, 2008
INVENTOR(S) : Alexander G. Chen et al.

It is certified that error appears in the above-identified patent and that said Letters Patent is hereby corrected as shown below:

In column 5, claim 7, line 53, delete “in” and insert --is--

In column 6, claim 15, line 43, delete “die” and insert --the--.

Signed and Sealed this

Second Day of September, 2008

JON W. DUDAS
*Director of the United States Patent and Trademark Office*